US010107174B2

(12) United States Patent
Nakaji et al.

(10) Patent No.: US 10,107,174 B2
(45) Date of Patent: Oct. 23, 2018

(54) WORK VEHICLE

(71) Applicant: Kubota Corporation, Osaka-shi (JP)

(72) Inventors: Masaru Nakaji, Sakai (JP); Toshiki Ono, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 15/355,752

(22) Filed: Nov. 18, 2016

(65) Prior Publication Data

US 2017/0159544 A1 Jun. 8, 2017

(30) Foreign Application Priority Data

Dec. 7, 2015 (JP) ..... 2015-238680

(51) Int. Cl.
*F01P 7/02* (2006.01)
*F01P 5/06* (2006.01)
*F01P 1/02* (2006.01)

(52) U.S. Cl.
CPC .. *F01P 5/06* (2013.01); *F01P 1/02* (2013.01)

(58) Field of Classification Search
CPC ..... F01P 5/06; F01P 1/02; F01P 11/10
See application file for complete search history.

(56) References Cited

U.S. PATENT DOCUMENTS 1,570,111 A * 1/1926 Wickware ..... F01P 7/10 454/143
1,660,145 A * 2/1928 Winans ..... F01P 7/10 165/41
2,654,354 A * 10/1953 Sanders ..... B60B 7/0086 123/41.05
8,439,141 B2 5/2013 Bessho et al.
2012/0055729 A1 3/2012 Bessho et al.

FOREIGN PATENT DOCUMENTS

JP 200542705 A * 2/2005
JP 201251506 A 3/2012

* cited by examiner

*Primary Examiner* — Hung Q Nguyen
(74) *Attorney, Agent, or Firm* — The Webb Law Firm

(57) ABSTRACT

A work vehicle includes an engine, a cooling fan for feeding cooling air to the engine, a fan cover for covering the cooling fan, and a shutter device provided at an ambient air inlet of the fan cover and openable and closable.

3 Claims, 5 Drawing Sheets

WORK VEHICLE

CROSS-REFERENCE TO RELATED APPLICATION

This application claims priority to Japanese Patent Application No. 2015-238680 filed Dec. 7, 2015, the disclosure of which is hereby incorporated in its entirety by reference.

BACKGROUND OF THE INVENTION

Field of the Invention

The present invention relates to a work vehicle including an engine, a cooling fan for feeding cooling air to the engine, and a fan cover for covering the cooling fan.

Description of the Related Art

As an example of the work vehicle described above, a work vehicle is known from e.g. Patent Document 1 (Japanese Unexamined Patent Application Publication No. 2012-51506). The work vehicle disclosed in Patent Document 1 includes an engine, a cooling fan (referred to as a "fan" in the document) for feeding cooling air to the engine, and a fan cover (referred to as a "case" in the document) for covering the cooling fan. In the fan cover, there is formed an ambient air inlet (referred to as an "opening for intake" in the document). With this work vehicle disclosed in Patent Document 1, as the cooling fan is driven by the engine, ambient air is introduced via an ambient air inlet to cool the engine.

SUMMARY OF THE INVENTION

Problem to be Solved by Invention

With the work vehicle disclosed in Patent Document 1, the cooling fan is constantly driven during engine operation. Therefore, even when the engine is engaged in a warm-up operation, cooling air from the cooling fan is fed to this engine, thus making warm-up of the engine difficult.

In view of the above-described state of the art, there is a need for a work vehicle that can feed cooling air of a cooling fan to the engine as needed.

Solution

According to a characterizing feature of the present invention, a work vehicle comprises:

an engine;

a cooling fan for feeding cooling air to the engine;

a fan cover for covering the cooling fan; and a shutter device provided at an ambient air inlet of the fan cover and openable and closable.

With the above-described feature, by opening/closing the shutter device, it is possible to feed cooling air of the cooling fan to the engine as needed. For instance, during a warm-up operation of the engine, the shutter device will be closed, so that ambient air introduced into the ambient air inlet is blocked and the warm-up operation of the engine will not be inhibited by the cooling air of the cooling fan. And, after the engine has been warmed up sufficiently, the shutter device will be opened, whereby the cooling air of the cooling fan is now fed to the engine, so that the engine can be cooled in an efficient manner.

Further, in the present invention, preferably:

the shutter device is configured to allow adjustment of its opening degree.

With the above-described feature, by adjusting the opening degree of the shutter device, an amount of ambient air to be introduced through the ambient air inlet can be set appropriately.

Further, in the present invention, preferably:

the shutter device includes a first shutter plate having an aperture and a second shutter plate having an aperture;

the first shutter plate and the second shutter plate are rotatable to each other about a rotational axis of the cooling fan; and the adjustment of the opening degree of the shutter device is effected in accordance with an amount of overlap between the aperture of the first shutter plate and the aperture of the second shutter plate.

With the above-described feature, the shutter device can be formed compact of the two plate-like members overlapped each other in the direction of the rotational axis of the cooling fan.

Further, in the present invention, preferably:

an operational member for opening/closing the shutter device is provided in a driving section where a passenger rides.

With the above-described feature, the shutter device can be opened/closed by the operational member from the driving section, without the passenger getting off the driving section.

EMBODIMENT

An embodiment of the present invention will be explained with reference to the accompanying drawings. Incidentally, in the following explanation, a direction of arrow F shown in FIG. 1 represents "vehicle body front side", a direction of arrow B represents "vehicle body rear side", a direction on the left side facing the direction of the arrow F represents "vehicle body left side" and a direction on the right side facing the direction of the arrow F represents "vehicle body right side", respectively.

[General Configuration of Utility Vehicle]

Figure 1:
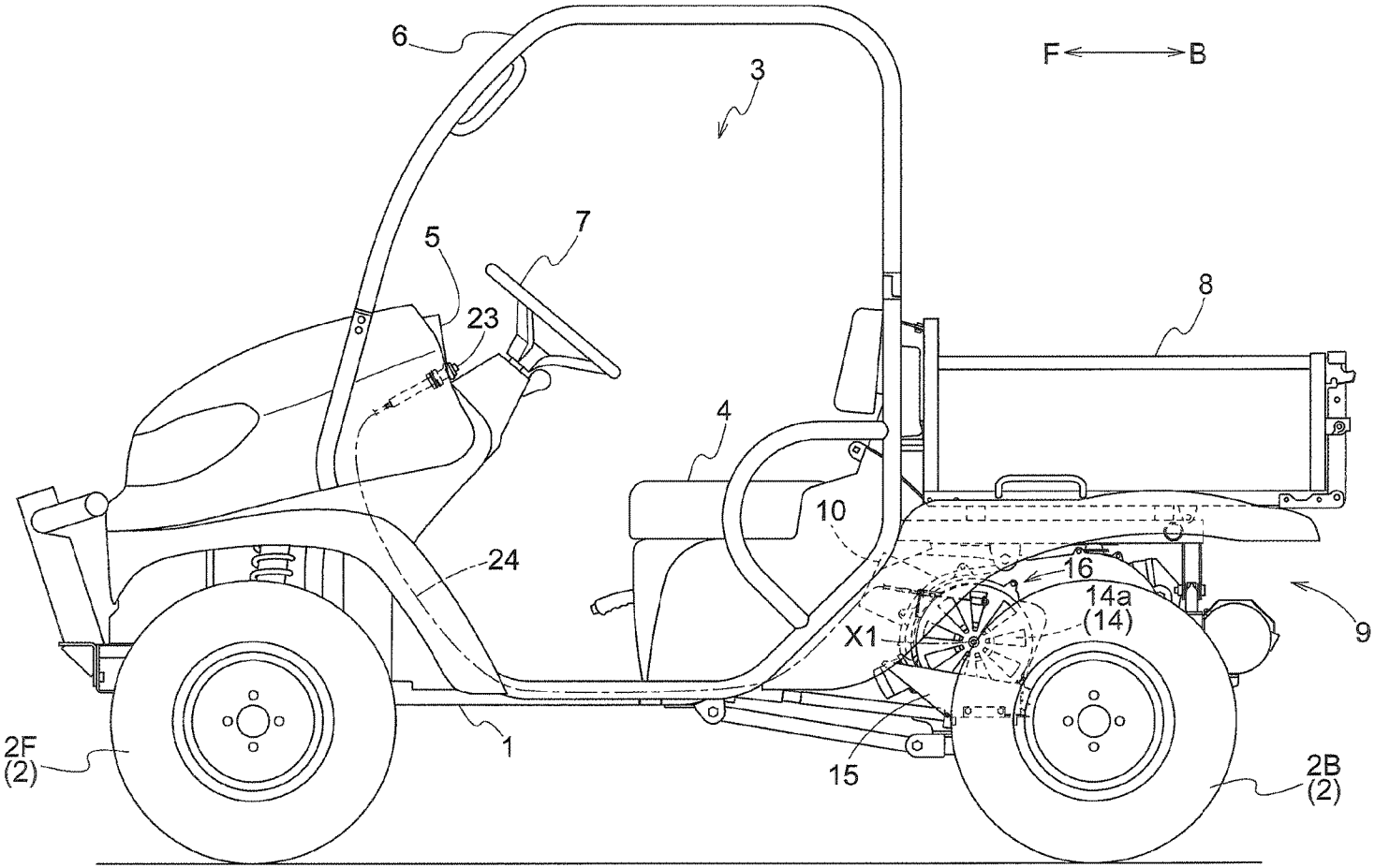
FIG. 1 is a left side view showing a utility vehicle.

FIG. 1 shows a utility vehicle (a multi-purpose vehicle) corresponding to the "work vehicle" relating to the invention. This utility vehicle includes a vehicle body frame 1, and a wheel-type traveling device 2 supporting the vehicle body frame 1. The traveling device 2 includes a pair of left and right front wheels 2F that can be steered and driven and a pair of left and right rear wheels 2B that can be driven. The traveling device 2 is switchable between a four-wheel drive mode and a two-wheel drive mode.

At a front-rear center portion of the vehicle body frame 1, there is provided a driving section 3 where a passenger is to ride. The driving section 3 includes a driver's seat 4 to be seated by a driver, a front panel 5 and a ROPS 6 for passenger protection. The front panel 5 includes a steering wheel 7, a meter panel (not shown), etc.

At a rear portion of the vehicle body frame 1, a loading platform 8 is provided. The loading platform 8 is vertically pivotable about a rear pivot for dumping a load thereon to the rear side. Downwardly of the loading platform 8, an engine section 9 is provided.

[Engine Section]

Figure 2:
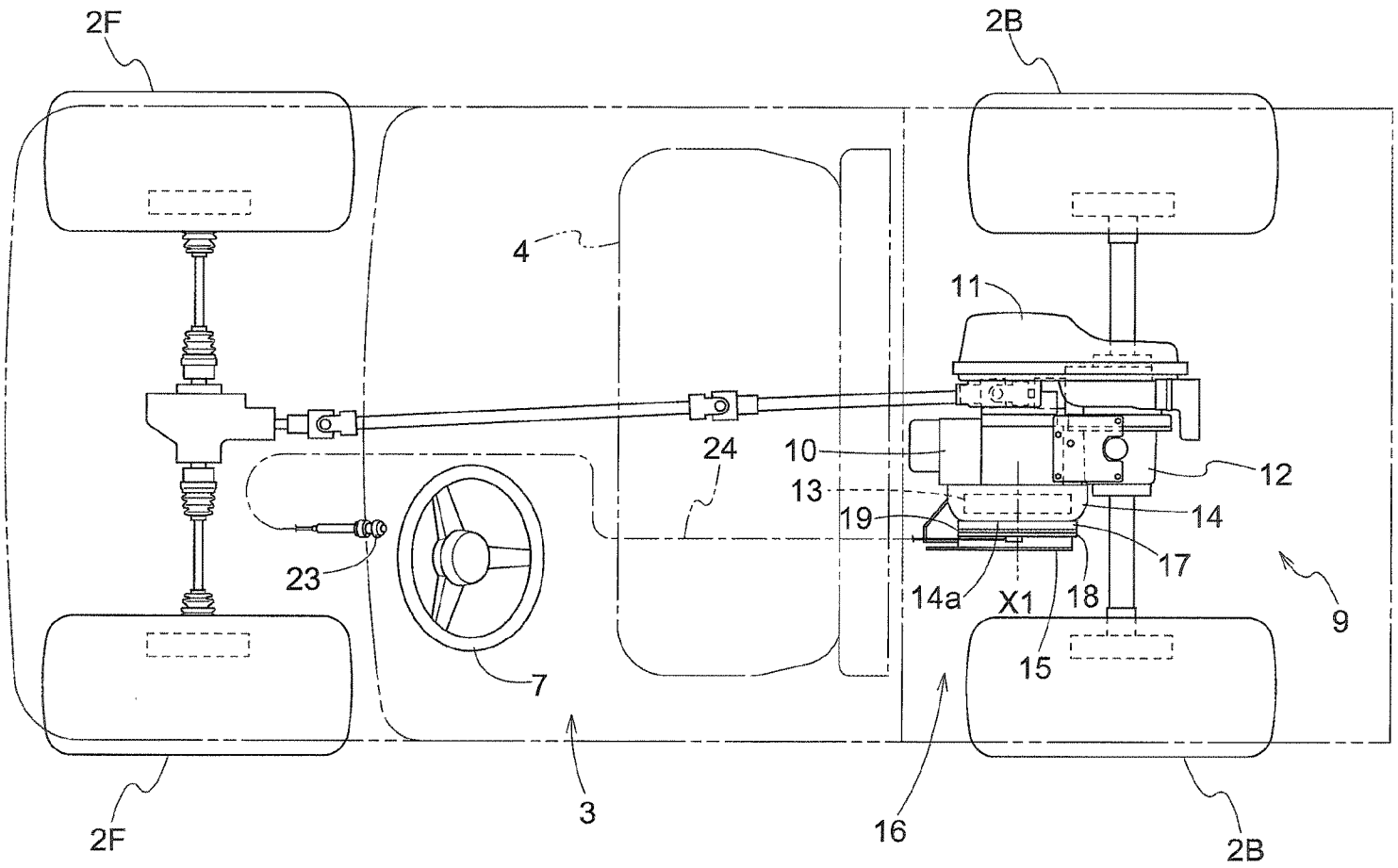
FIG. 2 is a plane view showing the utility vehicle.

As shown in FIG. 2, the engine section 9 includes an air-cooled gasoline engine (to be referred to simply as "engine" hereinafter) 10, a belt stepless speed changer device 11 for steplessly changing speed of the drive power of the engine 10, a transmission 12 for transmitting speed-changed power from the belt stepless speed changer device 11 to the traveling device 2, and a cooling fan 13 for feeding cooling air to the engine 10. The transmission 12 includes a gear speed changer mechanism (not shown), a differential mechanism (not shown), etc.

[Cooling Fan]

The cooling fan 13 is provided on the left side of the engine 10. The cooling fan 13 has its rotational axis X1 extending in a vehicle body left-right direction. A rotation shaft (not shown) of the cooling fan 13 is connected directly to an output shaft (not shown) of the engine 10.

[Fan Cover]

A fan cover 14 for covering the cooling fan 13 is provided. On the left side of the fan cover 14, an ambient air inlet 14*a* is provided. A dirt-proof guard 15 is provided for preventing introduction or adherence of dirt to the ambient air inlet 14*a*.

[Shutter Device]

Figure 3:
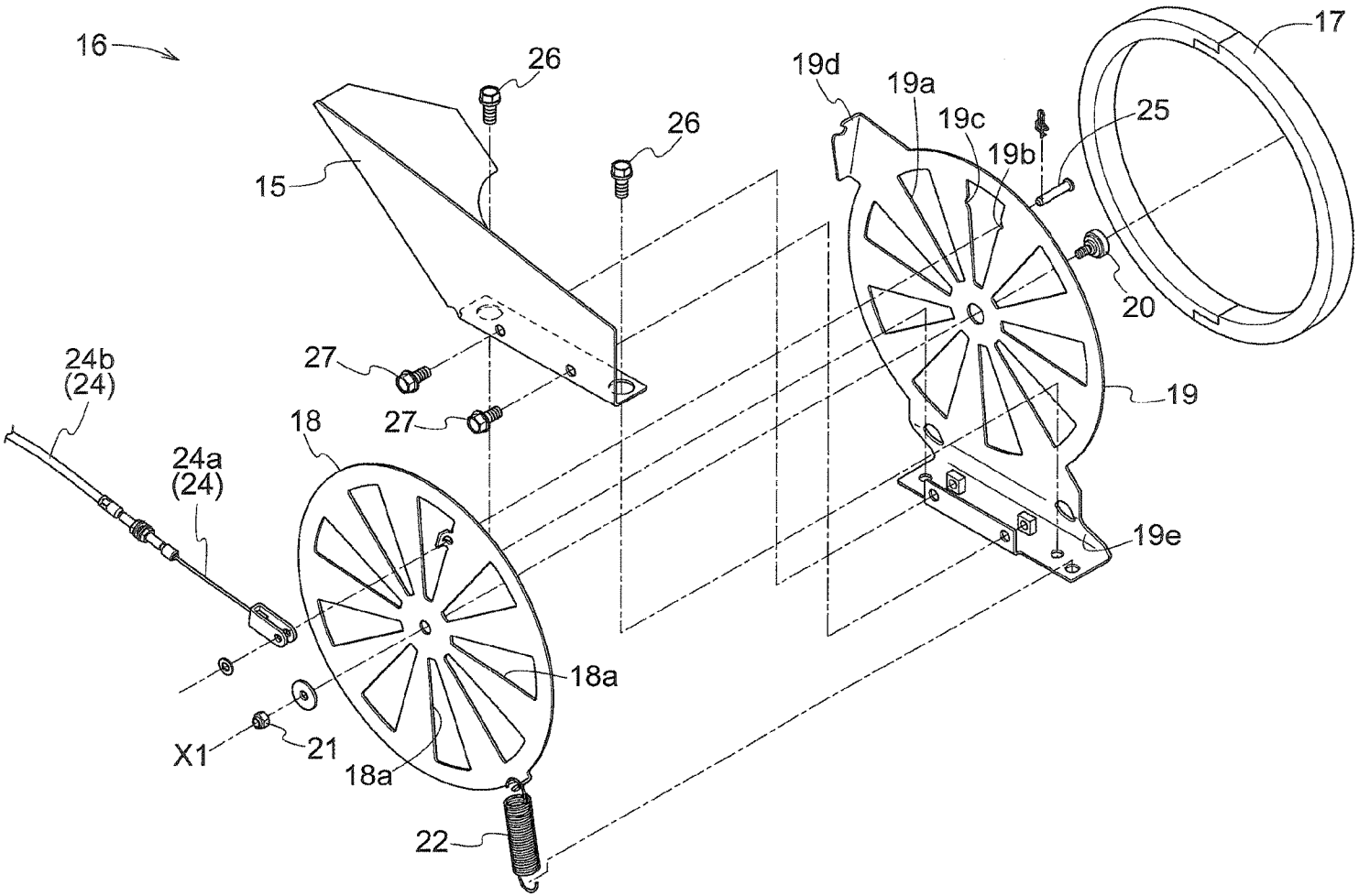
FIG. 3 is an exploded perspective view showing a shutter device.

As shown in FIG. 2 and FIG. 3, at the ambient air inlet 14*a*, there is provided an openable/closable shutter device 16. The shutter device 16 can be switched over between an opened state (see FIG. 4) and a closed state (see FIG. 5). Between the shutter device 16 and the fan cover 14, there is provided a seal 17 for sealing a gap formed between the shutter device 16 and the fan cover 14. The shutter device 16 includes a first shutter plate 18 and a second shutter plate 19. In the rotational axis X1 direction (the vehicle body left-right direction), the first shutter plate 18 and the second shutter plate 19 are overlapped with each other, with the first shutter plate 18 being disposed on a vehicle body lateral outer side (left side) and the second shutter plate 19 being disposed on a vehicle body lateral inner side (right side). The first shutter plate 18 and the second shutter plate 19 are connected to each other via a bolt 20 and a nut 21.

[First Shutter Plate]

The first shutter plate 18 is rotatable about the rotational axis X1 between an opened position corresponding to the opened state of the shutter device 16 and a closed position corresponding to the closed state of the shutter device 16. The first shutter plate 18 is urged by a spring 22 to be rotated about the rotational axis X1 toward the opened position side. The first shutter plate 18 comprises a plate-like member having an approximately round shape. The first shutter plate 18 defines a plurality of first apertures 18*a*. These multiple first apertures 18*a* are arranged equidistantly about the rotational axis X1. And, each first aperture 18*a* is formed circumferentially wider on the radial outer side thereof.

[Shutter Opening/Closing Lever]

A shutter opening/closing lever 23 (corresponding to what is referred to as "operational member" in the present invention) for opening/closing the shutter device 16 is provided in the driving section 3 (e.g. at the front panel 5, etc.). The shutter opening/closing lever 23 is operably coupled with the first shutter plate 18 via a coupling wire 24. An end portion of the coupling wire 24 (inner wire 24*a*) on the side of the first shutter plate 18 is connected to a pin 25 which protrudes from the first shutter plate 18 toward the vehicle body lateral outer side (left side). An end portion of the coupling wire 24 (outer wire 24*b*) on the side of the first shutter plate 18 is supported to a supporting portion 19*d* under a posture tilted rearwardly downwards. This arrangement serves to prevent intrusion of water to the inside of the outer wire 24*b*.

[Second Shutter Plate]

The second shutter plate 19 comprises a plate-like member having an approximately round shape. The second shutter plate 19 defines a plurality of second apertures 19*a*. These multiple second apertures 19*a* are arranged equidistantly about the rotational axis X1. And, each second aperture 19*a* is formed circumferentially wider on the radial outer side thereof.

Into one second aperture 18*a* of the plurality of second apertures 19*a*, the pin 25 is inserted to extend therethrough. When the first shutter plate 18 is rotated about the rotational axis X1 between the opened position and the closed position, the head portion of the pin 25 comes into contact respectively with the opposed circumferential sides of the second aperture 19*a*. On opposed circumferential sides of one second aperture 19*a*, there are formed an opened-position positioning recess 19*b* for fixing the first shutter plate 18 at the opened position and a closed-position positioning recess 19*c* for fixing the first shutter plate 18 at the closed position. The opened-position positioning recess 19*b* and the closed-position positioning recess 19*c* are formed as arcuate recesses conforming to the outer circumferential shape of the head portion of the pin 25.

Upwardly of the second shutter plate 19, there is provided the supporting portion 19*d* for supporting the first shutter plate 18 side end of the coupling wire 24 (outer wire 24*b*). This supporting portion 19*d* is formed integral with the second shutter plate 19.

Downwardly of the second shutter plate 19, there is provided an attaching base portion 19*e* to be attached to a frame (not shown). This attaching base portion 19*e* is formed integral with the second shutter plate 19. The attaching base portion 19*e* is fixed to the frame by a bolt 26, together with the dirt-proof guard 15. The attaching base portion 19*e* and the dirt-proof guard 15 are connected to each other via a bolt 27. Between the attaching base portion 19*e* and the first shutter plate 18, there is provided the spring 22 for urging the first shutter plate 18 for its rotation about the rotational axis X1 toward the opened position side.

[Opening/Closing of Shutter Device]

Figure 4:
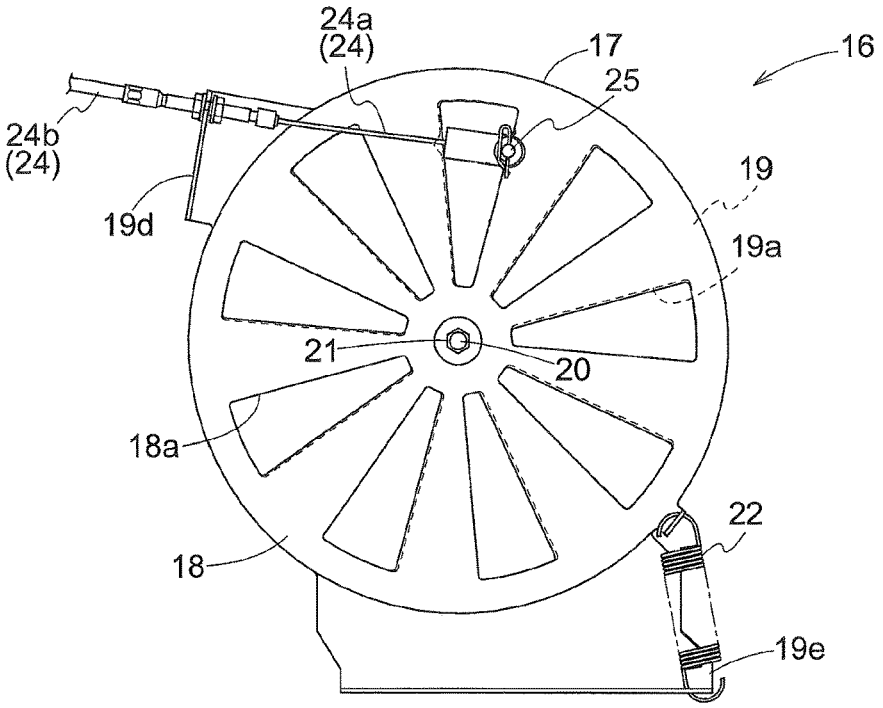
FIG. 4 is a left side view showing the shutter device under its opened state.

As shown in FIG. 4, when the coupling wire 24 is not pulled by the shutter opening/closing lever 23, the first shutter plate 18 is rotated about the rotational axis X1 by the spring 22 toward the opened position side. Then, the head portion of the pin 25 comes into contact with the opened-position positioning recess 19*b*, whereby the first shutter plate 18 is fixed at the opened position by the opened-position positioning recess 19*b*. In this way, the shutter device 16 is switched to the opened state.

Figure 5:
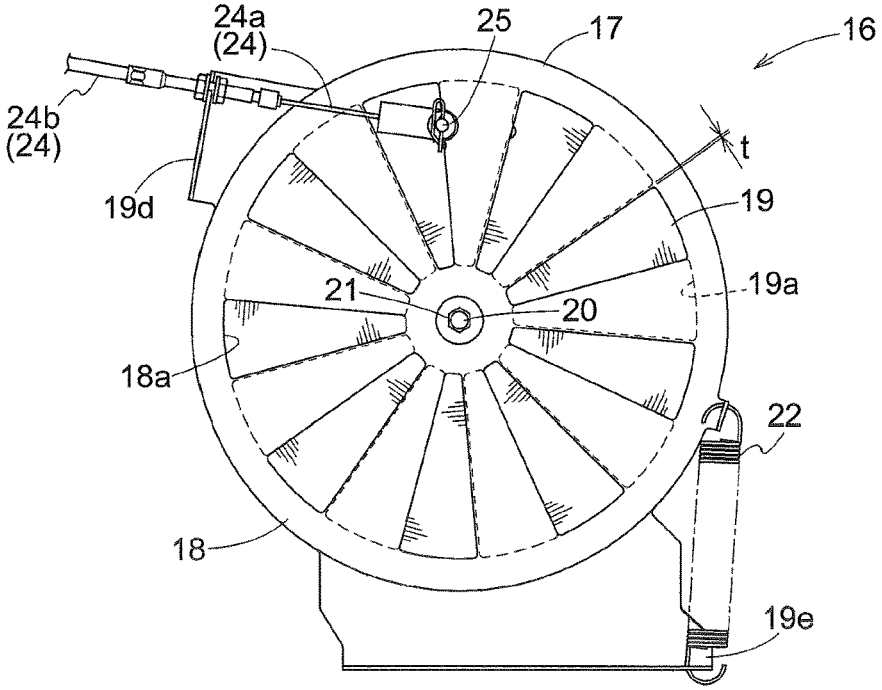
FIG. 5 is a left side view showing the shutter device under its closed state.

And, as shown in FIG. 5, when the coupling wire 24 is pulled by the shutter opening/closing lever 23, the first shutter plate 18 is rotated about the rotational axis X1 against the urging force of the spring 22 toward the closed position side. Then, the head portion of the pin 25 comes into contact with the closed-position positioning recess 19*c*, whereby the first shutter plate 18 is fixed at the closed position by the closed-position positioning recess 19*c*. In this way, the shutter device 16 is switched to the closed state. Under this closed state, the non-apertured portion of the first shutter plate 18 and the non-apertured portion of the second shutter plate 19 are overlapped with each other by a width (t) about the rotational axis X1 such that an edge portion of the first aperture 18*a* of the first shutter plate 18 and an edge portion of the second aperture 19*a* of the second shutter plate 19 are meshed with each other, thus preventing the first shutter plate 18 from being returned to the opened state inadvertently.

Thereafter, when the pulling operation on the coupling wire 24 by the shutter opening/closing lever 23 is released, the shutter device 16 is switched over to the opened state in the manner described above.

With the above-described configuration, by opening/closing the shutter device 16, cooling air of the cooling fan 13 can be fed to the engine 10 as needed or desired. For instance, during a warm-up operation of the engine 10, by closing the shutter device 16, introduction of ambient air into the ambient air inlet 14*a* is blocked, so that the warm-up operation of the engine 10 will not be inhibited by the cooling air of the cooling fan 13. And, after the engine 10 has been warmed up sufficiently, by opening the shutter device 16, cooling air of the cooling fan 13 is now fed to the engine 10, whereby the engine 10 can be cooled efficiently. In particular, in this embodiment, since the engine 10 comprises a gasoline engine, it is possible to improve dilution of engine lubricant oil, so-called "dilution" phenomenon, by mixing of un-combusted gasoline into the engine lubricant oil.

[Other Embodiments]

Figure 6:
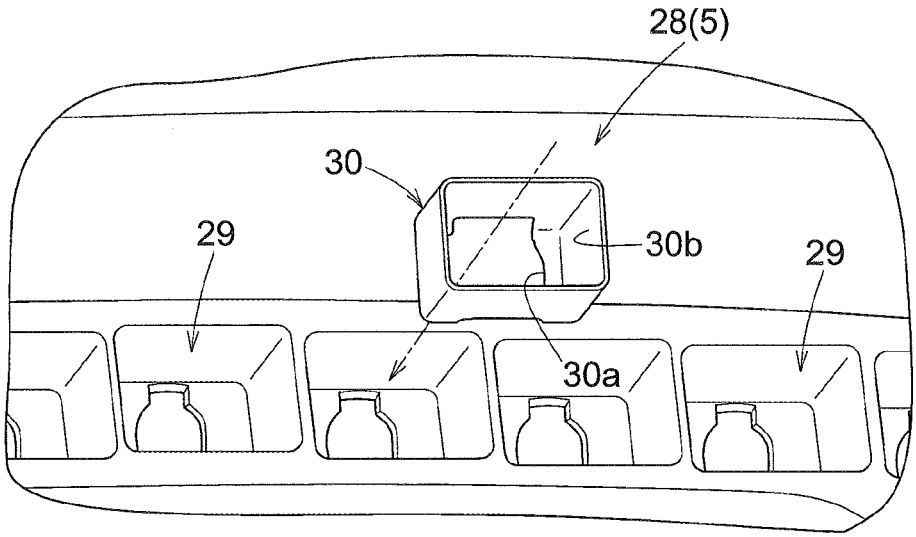
FIG. 6 is a perspective view showing indicator lamps.

(1) As shown in FIG. 6, the front panel 5 is provided with various kinds of indicator lamps 28. The indicator lamps 28 are constituted by attaching electric bulbs (e.g. candescent lamps, LED bulbs, etc., not shown) to recesses 29 defined in a back face of a transmitting panel (not shown). Within each recess 29, a box-like reflector 30 is fitted. The reflector 30 defines, in its deep side face, an opening portion 30*a* for allowing insertion of the electric bulb and also defines, in its near side face, an opening portion 30*b* for allowing passage of beam of the electric bulb. The inner face of the reflector 30 is provided with a surface treatment for mirror-face reflection. With this arrangement, the beam of the electric bulb is reflected by the reflector 30, thus improving visibility for the passenger. Further, as the arrangement requires merely fitting the reflector 30 into the recess 29, the arrangement provides superior assembly efficiency in comparison with an arrangement of e.g. affixing a reflector plate to the inside of the recess 29.

(2) In the foregoing embodiment, the engine 10 comprises an air-cooled gasoline engine. Instead, it can also be a water-cooled gasoline engine, an air-cooled diesel engine, a water-cooled diesel engine, etc.

(3) For the first shutter plate 18, an intermediate position (semi-opened position) can be provided between the opened position and the closed position. In this case, the semi-opened position can be one such position or a plurality of such positions.

(4) In the foregoing embodiment, the shutter device 16 is configured such that the first shutter plate 18 is rotated relative to the second shutter plate 19 about the rotational axis X1 (rotary opening/closing type). However, the present invention is not limited thereto. For instance, the shutter device 16 can be configured such that the first shutter plate 18 slides relative to the second shutter plate 19 in the direction perpendicular to the rotational axis X1 (slide opening/closing type). Further alternatively, the shutter device 16 can be configured such that the first shutter plate 18 is pivoted relative to the second shutter plate 19 about a pivot axis which is perpendicular to the rotational axis X1 (pivot opening/closing type).

(5) The numbers of the first apertures 18*a* and the second apertures 19*a* are not limited to those relating to the foregoing embodiment. For instance, the first aperture 18*a* and the second aperture 19*a* can be provided only one each.

(6) In the foregoing embodiment, the "operational member" relating to the invention is constituted of the shutter opening/closing lever 23. However, it can be constituted of a pedal.

(7) In the foregoing embodiment, the shutter device 16 (attaching base portion 19*e*) is fixed together with the dirt-proof guard 15 by means of the bolt 26. Instead, at the attaching base portion 19*e*, there can be formed a bolt hole corresponding to the bolt 26, in the form of a cutout. With this, when the shutter device 16 is attached later, the shutter device 16 can be attached by sliding after insertion of the bolt 26 through the cutout of the bolt hole, only with slight loosening of the bolt 26 without complete removal thereof.

(8) The present invention is applicable not only a utility vehicle, but also to a tractor, a rice planter machine, a combine, and is applicable not only to an agricultural work vehicle, but also to a civil engineering work vehicle.

The invention claimed is:

1. A work vehicle comprising:

an engine;

a cooling fan for feeding cooling air to the engine;

a fan cover for covering the cooling fan;

a shutter device provided at an ambient air inlet of the fan cover and openable and closable, the shutter device comprising a first shutter plate having an aperture and a second shutter plate having an aperture; and an operational member for opening/closing the shutter device is provided in a driving section where a passenger rides and operatively connected to one of the first shutter plate and the second shutter plate.

2. The work vehicle according to claim 1, wherein the shutter device is configured to allow adjustment of its opening degree.

3. The work vehicle according to claim 2, wherein:

the first shutter plate and the second shutter plate are rotatable to each other about a rotational axis of the cooling fan; and the adjustment of the opening degree of the shutter device is effected in accordance with an amount of overlap between the aperture of the first shutter plate and the aperture of the second shutter plate.

* * * * *